US005865003A

United States Patent [19]

Klett et al.

[11] Patent Number: 5,865,003

[45] Date of Patent: Feb. 2, 1999

[54] REINFORCED GLASS FIBER MAT AND METHODS OF FORMING

[75] Inventors: Paul A. Klett, Newark; David E. Adam, Pataskala, both of Ohio

[73] Assignee: Owens Corning Fiberglas Technology, Inc., Summit, Ill.

[21] Appl. No.: 924,362

[22] Filed: Sep. 5, 1997

[51] Int. Cl.[6] ..... E04D 1/16; E04D 1/22; B32B 17/06

[52] U.S. Cl. ..... 52/518; 83/920; 156/62.2; 162/156; 428/426; 428/436; 428/440; 442/176; 442/180; 442/327

[58] Field of Search ..... 52/518, 554, 557; 83/920; 156/62.2; 162/156; 428/426, 436, 440; 442/176, 180, 327

[56] References Cited

U.S. PATENT DOCUMENTS

| | | | |
|---|---|---|---|
| 1,745,361 | 2/1930 | Mickelson . | |
| 1,758,410 | 5/1930 | Reichel . | |
| 1,834,004 | 12/1931 | Overbury et al. . | |
| 1,863,178 | 6/1932 | Wood . | |
| 1,868,751 | 7/1932 | Koch . | |
| 1,924,650 | 8/1933 | Payne | 52/518 |
| 1,950,032 | 3/1934 | Kirschbaun | 52/518 |
| 1,972,133 | 9/1934 | Darrow . | |
| 5,362,842 | 11/1994 | Graves et al. | 528/262 |
| 5,445,878 | 8/1995 | Mirous | 442/327 |
| 5,656,366 | 8/1997 | Mirous | 442/327 |

*Primary Examiner*—Christopher Kent
*Attorney, Agent, or Firm*—C. Michael Gegenheimer; Inger H. Eckert

[57] ABSTRACT

A glass fiber mat includes glass fibers saturated with a binder and then cured. A predetermined pattern of relatively high and low concentrations of binder is formed throughout the length of the glass fiber mat. The pattern produces at least one portion of the mat having a relatively high concentration of binder adjoining a portion of the mat having a relatively low concentration of binder. The pattern of high and low binder concentration is produced during a wet process. Liquid binder is either selectively applied to the glass fibers via an applicator or selectively removed from the glass fibers via a vacuum. Cover panels having predetermined slot configurations are used with vacuum boxes to create the desired pattern. Such glass fiber mats can be cut along an area of high binder concentration to produce cut edges which resist breaking and tearing. Shingles formed from such glass fiber mats have improved tear resistance and pliability.

25 Claims, 3 Drawing Sheets

REINFORCED GLASS FIBER MAT AND METHODS OF FORMING

TECHNICAL FIELD AND INDUSTRIAL APPLICABILITY OF THE INVENTION

This invention relates generally to glass fiber mats, and in particular to a reinforced glass fiber mat and methods of forming such a mat.

BACKGROUND OF THE INVENTION

Asphalt roofing shingles are based on an interior web or carrier commonly formed as a glass fiber mat in a wet process. Shingle manufacturing consists of running a continuous wet process glass fiber mat in a bath of molten asphalt to cause a coating on both sides of the mat, as well as filling the interstices between the individual glass fibers.

Wet process glass fiber mats are conventionally made from glass fibers held together by a binder comprising a thermoset polymer system. Typically, a binder is applied in a liquid form and dispersed onto the glass fibers through an applicator such as a curtain coater. Conventional wet processes strive to produce a uniform coating of binder on the glass fibers. After the binder and glass fibers have been dried and cured in an oven, the glass fiber mat is gauged and cut as desired.

Typically, cuts are made in a glass fiber mat along the longitudinal length of the mat to produce several mats of a desired width. Each cutting operation produces side edges for each of the narrower mats. The cutting operation may expose or produce weaker areas in the mat along the side edges. The weakened mat edge can break during a coating process or result in a shingle having a weakened edge, i.e., an edge prone to tearing or breaking during handling or installation. Conventional techniques for reinforcing such edges include the addition of a yarn or tape to the desired portion of the glass fiber mat. The addition of such materials can increase the cost of manufacture of glass fiber mats.

It is desirable to improve the performance of glass fiber mats and prevent cut edges from exposing areas prone to breaking or tearing. Furthermore, it is desirable to produce glass fiber mats which produce shingles having increased tear strength and pliability.

SUMMARY OF THE INVENTION

This invention relates to reinforced glass fiber mats and methods for forming reinforced glass fiber mats. A glass fiber mat according to this invention includes a reinforced portion which provides additional tear strength and resistance to breaking along cut edges. The present reinforced glass fiber mat can be formed with conventional binders and does not require additional materials or additional process steps. Improved roofing shingles can be manufactured from the present glass fiber mat via conventional coating techniques.

In a preferred embodiment, a glass fiber mat includes glass fibers saturated with a binder and then cured. A predetermined pattern of relatively high and low concentrations of binder is formed throughout the length of the glass fiber mat. The pattern produces at least one portion of the mat having a relatively high concentration of binder adjoining a portion of the mat having a relatively low concentration of binder. The pattern of high and low binder concentrations is produced during a binder saturation step of a wet process. Liquid binder is either selectively applied to the glass fibers via an applicator or selectively removed from the glass fibers via a vacuum. Cover panels having predetermined slot configurations are used with vacuum boxes to create the desired pattern. Such glass fiber mats can be cut through an area of high binder concentration to produce reinforced edges which resist breaking and tearing. Shingles formed from such glass fiber mats have improved tear resistance and pliability.

Various objects and advantages of this invention will become apparent to those skilled in the art from the following detailed description of the preferred embodiment, when read in light of the accompanying drawings.

DETAILED DESCRIPTION AND PREFERRED EMBODIMENTS OF THE INVENTION

Figure 1:
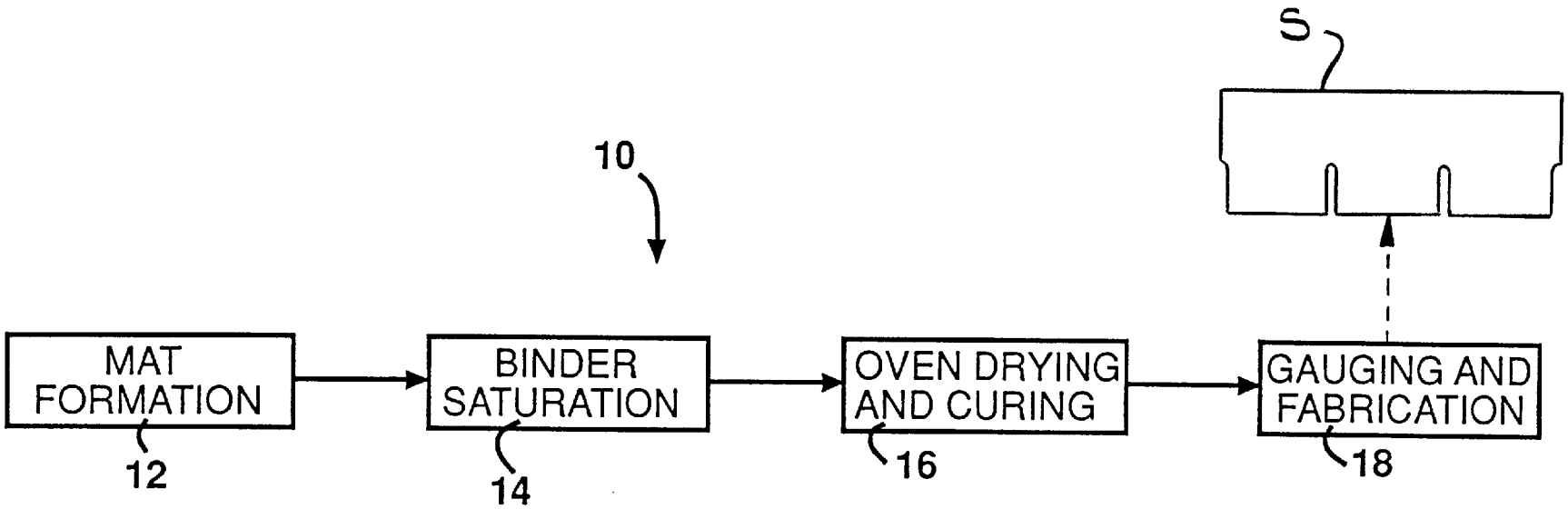
FIG. 1 is a flow diagram of a four-step wet process for forming a glass fiber mat according to this invention.

A schematic representation of a four-step wet process for forming a glass fiber mat according to this invention is indicated generally at 10 in FIG. 1. Preferably the process 10 is a conveyor-based operation wherein a desired product-in-process travels between four stations on a conveyor system and results in a finished glass fiber mat at the end of the process 10.

Glass fibers are an essential ingredient for forming a glass fiber mat according to the process 10. Typically, glass fibers are formed, chopped, packaged and delivered for use in the process 10. Any conventional process can be used to make the glass fibers. One such process is known as the rotary process, in which molten glass is placed into a rotating spinner which has orifices in the perimeter, wherein glass flows out the orifices to produce a downwardly falling stream of fibers which are collected on a conveyor. A second fiber forming process is a continuous process in which glass fibers are mechanically pulled from the orificed bottom wall of a feeder or bushing containing molten glass. Substantially contemporaneous with forming, the glass fibers are brought into contact with an applicator wherein a size is applied to the fibers. The sized glass fibers are then chopped to a specified length and packaged. Glass fibers made by these processes are commercially available from Owens Corning, Toledo, Ohio.

Mat formation occurs during a first station 12 of the process 10. Glass fibers are unpacked, arranged and dispersed into an unbonded mat. Preferably, the glass fibers are dispersed into a water solution and carried by a conveyor.

Binder saturation occurs during a second station 14. A desired binder is applied to the glass fibers in the unbonded mat received from station 12. The binder, preferably in liquid form, is pumped from a reservoir and applied to the unbonded mat, preferably through an applicator. A vacuum removes excess binder from the treated mat.

Drying and curing occur during a third station 16. The treated mat is heated for a desired time in an oven (not illustrated) or the like so that the binder will cure and form a reinforced glass fiber mat.

Gauging and fabrication occur during a fourth station 18. At station 18, the glass fiber mat can be measured for various properties and prepared for shipment. The glass fiber mat can be cut as desired at station 18 by such means as a rotary blade or water jet (not illustrated). Afterwards, the glass fiber mat can be coated with asphalt in a well known manner and cut to form shingles, one of which is indicated generally at S in FIG. 1.

Figure 2:
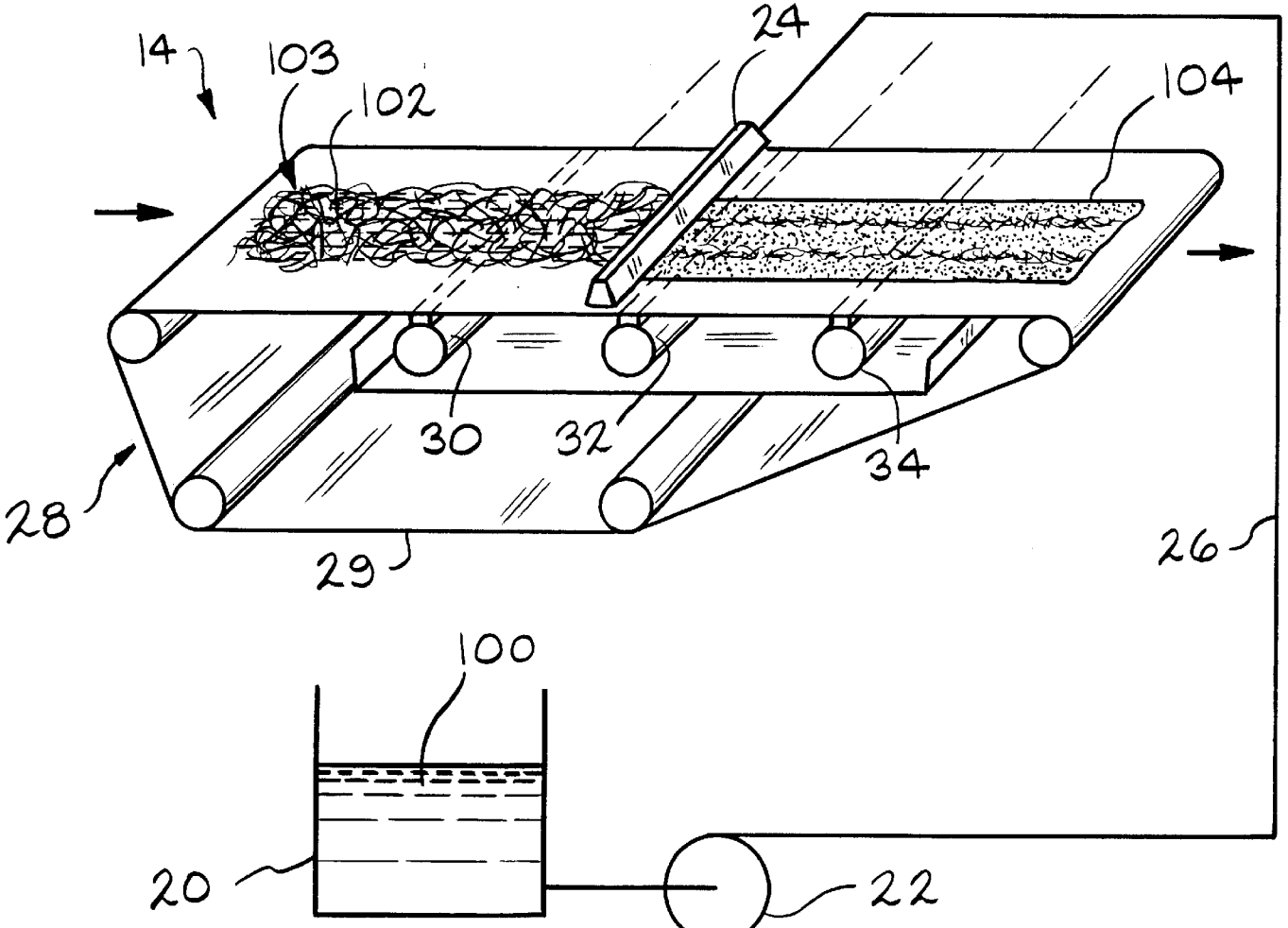
FIG. 2 is a pictorial sketch of the binder saturation station of the process of FIG. 1 illustrating a tank containing liquid binder, a pump for delivering binder to an applicator, and vacuum boxes for removing excess binder.

A pictorial sketch of the binder application station 14, presented as a flood-and-extract process, is illustrated in FIG. 2. A desired liquid binder 100 is stored in a reservoir or tank 20. One preferred binder according to this invention comprises urea-formaldehyde and latex. A pump 22 delivers binder 100 from the tank 20 to an applicator or weir 24 via conduit 26. Glass fibers 102, preferably dispersed into a water solution to form an unbonded mat 103, are carried by a conveyor belt 29 under the applicator 24 and above vacuum boxes 30, 32, and 34. The applicator 24 spans a desired portion of the width of the unbonded mat 103 and applies binder 100 as the glass fibers 102 pass beneath it. Vacuum box 30 removes excess water and wrinkles that may be present. Vacuum boxes 32 and 34 remove excess binder 100 and return it to the tank 20 or dispose of it as desired. The amount of vacuum applied to the treated mat 104 will affect the amount of liquid, and therefore the amount of binder 100 carried in the unbonded mat 102, that will be removed. Increased vacuum removes a greater amount of liquid, resulting in a lower concentration of binder 100 remaining with the glass fibers 102 in a treated mat 102. The treated mat 104 passes from station 14 to an oven or the like in the drying and curing station 16.

According to this invention, application and removal of binder 100 in station 14 creates alternating portions of relatively high and low concentrations of binder 100. Specifically, the treated mat 104 formed at station 14 has adjoining portions which have different percentages of glass fibers 102 and binder concentrations when measured by weight of the mat 104. These weight percentages are based on the weight of the glass fiber mat after it has been dried and is ready for use. LOI ("Loss On Ignition") is commonly used to measure the weight percent of binder 100 in the glass fiber mat 104. LOI is determined by burning off all the binder from the glass fibers and then measuring the weight loss. LOI is calculated as [(Initial Weight−Final Weight)/Initial Weight]. A portion of mat 104 with a higher concentration of binder 100 has a higher LOI than an adjoining portion which has a lower concentration of binder 100. In one example, a mat 104 had alternating portions of high and low concentrations of binder 100 wherein the high binder concentration was approximately 23% LOI and the low binder concentration was approximately 18% LOI. Preferably, a portion of the mat with a high concentration of binder 100 may have a value of up to 30% LOI, while a portion of the mat with a low concentration of binder 100 may have a value of up to 15% LOI. Preferably, a mat 104 will have adjoining portions of high and low concentrations of binder 100 wherein the difference is at least approximately 5% LOI between the high and low binder concentrations. The values for LOI stated above are dependent upon the particular binder 100 in an application As stated above, a desired binder 100 for this process 10 comprises urea-formaldehyde and latex, which was used in the stated example.

Figure 3:
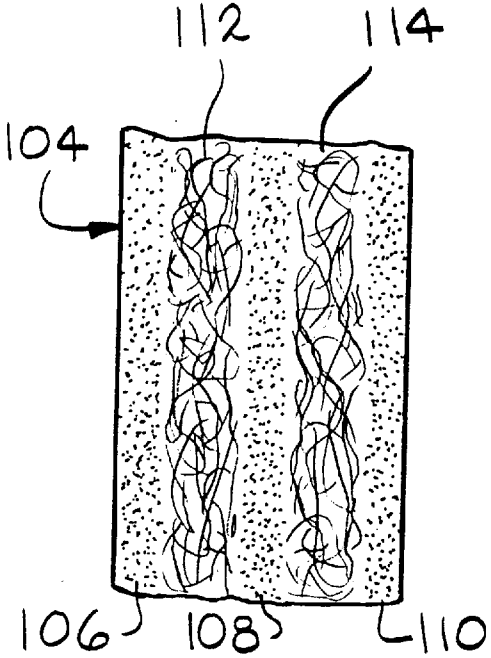
FIG. 3 is a top view of a first embodiment of a glass fiber mat according to this invention formed from the process illustrated in FIGS. 1 and 2.

The alternating portions of high and low binder concentration can produce visible stripes or patterns in the mat 104. As illustrated in the embodiment of FIG. 3, longitudinal stripes 106, 108, and 110 are formed along the length of the treated mat 104. The stripes 106, 108, and 110 are the result of a greater concentration of binder 100 in these portions of the treated mat 104 when compared to the concentration of binder in adjoining portions 112 and 114 of the treated mat 104. In certain applications, the greater concentrations of binder 100 may not be visible to the unaided eye, but can be detected by tests other than unaided visual inspection of the treated mat 104. The stripes 106, 108, and 110 are formed lengthwise in the treated mat 104 as it travels on the conveyor belt 29.

One or more stripes can be formed in the treated mat 104 in different ways. In one example, a portion or portions of a slot in a cover panel of a vacuum box can be blocked so that a vacuum force is not present against a portion(s) of the traveling treated mat 104. In another example, a cover panel of a vacuum box can be formed with a series of aligned slots to create a pattern of strips. In yet another example, a portion or portions of a slot in a control plate associated with an applicator can be blocked or formed with a series of aligned slots so that liquid binder 100 is not applied to a portion(s) of the unbonded mat 102.

Figure 4:
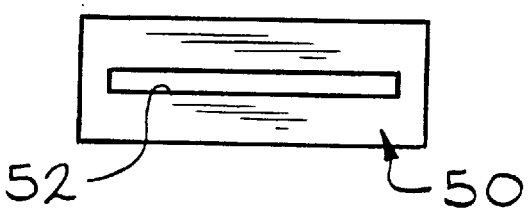
FIG. 4 (PRIOR ART)
FIG. 4 is a top view of a prior art cover panel having a single slot for use with a vacuum box of FIG. 2.

A prior art cover panel 50 is illustrated in FIG. 4. The cover panel 50 is typically mounted on vacuum boxes similar to vacuum boxes 32 and 34 illustrated in FIG. 2. As shown in FIG. 4, the cover panel 50 includes a narrow slot 52 which spans the width of the unbonded mat 103. In operation, a vacuum force sucks excess binder 100 from the treated mat 104 through slot 52 and returns the withdrawn liquid binder 100 to the tank 20 or disposes of it.

Figure 5:
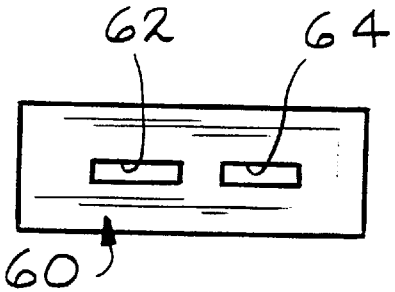
FIG. 5 is a top view of a cover panel having a series of aligned slots according to this invention for use with a vacuum box of FIG. 2.

According to this invention, a cover panel 60 illustrated in FIG. 5 is preferably used with a vacuum box downstream of the applicator 24. In the system illustrated in FIG. 2, cover panel 60 is most preferably used with vacuum box 34. Cover panel 60 includes a series of aligned slots 62 and 64 which span a desired width of mat 103. During operation at station 14, excess binder 100 is sucked through slots 62 and 64 so that the adjoining portions of the treated mat 104 have a greater concentration of binder 100, resulting in the appearance of longitudinal stripes 106, 104 and 110. The lighter portions 112 and 114 of FIG. 3 are the result of excess binder 100 removed by the vacuum force applied through slots 62 and 64. In other embodiments, any number or configuration of slots can be formed in a cover panel to produce a corresponding desired pattern of adjoining stripes (or other configurations) in the glass fiber mat. For example, if only a single stripe is desired at a mid-portion in a treated mat, a slot having a width less than the width of the mat could be formed by a corresponding slot formed in a cover plate.

Figure 6:
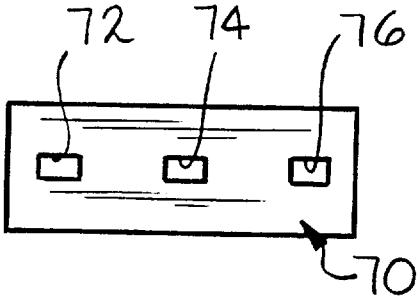
FIG. 6 is a top view of a control plate having a series of aligned slots according to this invention for use with an applicator of FIG. 2.

Alternatively, as shown in FIG. 6, a control plate 70 having a series of aligned slots 72, 74, and 76 can be mounted on the applicator 24 to produce stripes 106, 108 and 110 on the treated mat 104. Binder 100 is applied through slots 72, 74, and 76 and blocked from reaching portions of the unbonded mat 103 between slots 72, 74, and 76. In other embodiments, a predetermined number or configuration of slots can be formed in an applicator to produce a desired pattern of stripes in the mat.

Preferably, the opened and blocked portions of the cover panel 60 and control plate 70 are selected based on the length of glass fibers 102 or other inherent structural features of the glass fibers 102. If the spacing of slots is too wide, the resulting treated material may not have desired strengths and may lack a desired stripe pattern. Too narrow spacing of slots may show little variation from a conventional uniform coating.

Furthermore, it is desired that the treated mat 104 be dried and cured in a timely manner. If not dried properly, capillary forces may drive excess liquid binder 100 along the glass fibers 102 toward the drier areas, which tends to diminish the alternating high and low binder content of the treated mat 104. High liquid viscosity tends to maintain bonding patterns as will high processing speeds and short distances.

During the gauging and fabrication station 18, the treated mat 104 can be cut into desired widths. Preferably, a cutting operation can be performed along approximately a mid-portion of a stripe of higher concentration binder 100, such as stripes 106, 108, or 110 in the embodiment illustrated in FIG. 3. The additional binder 100 strengthens edges resulting from a cut through a stripe.

Figure 7:
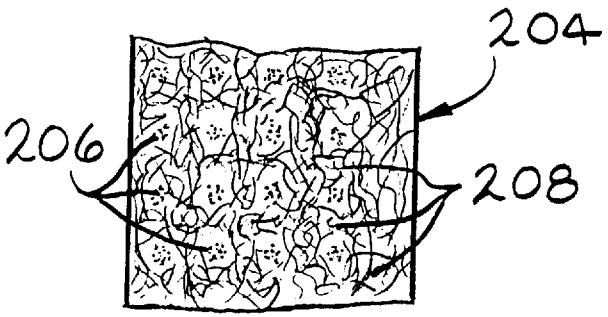
FIG. 7 is a top view of a second embodiment of a glass fiber mat according to this invention formed by the process illustrated in FIGS. 1 and 2.

In another embodiment illustrated in FIG. 7, a mat 204 can be formed with a predetermined pattern of binder 100. The pattern includes portions 206 of relatively high binder concentration adjoining portions 208 of relatively low binder concentration. The conveyor belt 29 is preferably formed from a semi-permeable material, such as screen or mesh material with relatively small openings. A non-permeable blocking material forming a desired pattern can be imprinted or mounted on the conveyor belt 29. During operation of the binder application station 14, a vacuum control box having a cover panel 50 will suck binder 100 from the glass fibers 102 except for the portions blocked by the blocking material mounted on the conveyor belt 29. Thus, a repeated pattern of portions 206 having a higher concentration of binder 100 as illustrated in FIG. 8 can be formed along the length of the mat 204. In other embodiments, the pattern of additional binder 100 may not be visible to an unaided observer but can detected in other ways. While circles are used to indicate areas 206 of higher binder concentration in FIG. 8, other shapes can be created by varying the shape of the blocking material mounted on the belt 29.

After the mat 204 is finished at station 18, it can be coated with asphalt in a well-known manner and cut to form roofing shingles. Shingles formed from mat 204 have increased tear resistance and pliability.

EXAMPLE

A first set of asphalt shingles was made using a first set of mats made with differentiated binder concentrations according to this invention. These shingles were compared with a second set of shingles made with a second set of mats that were similar to those made with the first set of mats, but had uniform binder concentrations. For each sample, both the first and second sets of shingles were made on the same shingle machine. Samples 1 and 2 were made on a pilot machine, and samples 3–7 were made on commercial production machines, using conventional shingle making technology. Sample portions of both types of shingles were cut out and tested for tensile strength and tear strength so that comparisons between the first and second sets of shingles could be made. The results of the tests are set forth in Table 1 as follows:

TABLE 1

| Mat Test Condition | | Shingle Physical Properties | | | | | |
|---|---|---|---|---|---|---|---|
| | | (MD + CD) Tensile, lb/2 in | | | (MD + CD) Tear, grams | | |
| Sample | Fiber Orientation | Experimental | Control | Percent Improvement | Experimental | Control | Percent Improvement |
| 1 | Square | 355 | 352 | 0.9 | 2999 | 2648 | 13.3 |
| 2 | Square | 368 | 352 | 4.5 | 3159 | 2648 | 19.3 |
| 3 | Square | 331 | 278 | 19.1 | 2463 | 2298 | 7.2 |
| 4 | Square | 311 | 278 | 11.9 | 2493 | 2298 | 8.5 |
| 5 | Square | 306 | 278 | 10.1 | 2394 | 2298 | 4.2 |
| 6 | Directional | 314 | 289 | 8.7 | 2649 | 2275 | 16.4 |
| 7 | Directional | 305 | 289 | 5.5 | 2470 | 2275 | 8.6 |

The tensile strength measurements were made in accordance to ASTM D828 specifications as referenced through ASTM D146 but modified by increasing the specimen width from 1.0" to 2.0" in order to reduce variability. The rate of extension was increased from 1.0" per minute to 2.0" per minute to meet sample rupture-time specifications. The instrumentation used met ASTM D76 specifications for a constant-rate-of-extension (CRE) tensile testing machine. The (MD+CD) Tensile data values shown represent the total calculated by summing the tensile strength measurements made in the machine direction and cross-machine direction for each sample, i.e., (MD+CD).

The tearing resistance was measured according to ASTM D689 specifications utilizing a Thwing-Albert, Pro Tear, Elmendorf-type tear tester (Model 60-2600). The (MD+CD) Tear data values shown represent the total tear strength calculated by summing the tear resistance measurements made in the machine direction and cross-machine direction for each sample, i.e., (MD+CD). All specimens for both tensile and tear strength measurements were single-ply.

The first 5 samples (from both the first and second set of mats) were made with mats having a square fiber orientation, i.e., the amount and length of the fibers in the machine direction was generally equal to the amount and length of fibers in the cross-machine direction. The final 2 samples (from both the first and second set of mats) were made with mats having a directional fiber orientation where the amount and length of the fibers in the machine direction was greater than the amount and length of fibers in the cross-machine direction. In the tear test the cross-machine direction testing invariably resulted in a tearing of the shingle across a portion of the mat having a relatively high binder concentration. It was not determined whether the machine direction testing involved tearing the shingle across a portion of the mat having a relatively high binder concentration.

It can be seen that in every experimental sample there was an improvement in tensile strength and an improvement in tear strength. Therefore, the method of the invention, and shingles made using the method of the invention, gave rise to stronger shingles.

The differentiation in binder concentrations between the areas of high and low binder of the mats used for the experimental shingles described above is set forth in Table 2 as follows:

TABLE 2

| | Mat Loss on Ignition (% loss) | | | | | | |
|---|---|---|---|---|---|---|---|
| | Experimental | | | | | Control | |
| | | Loss-On-Ignition, % | | | | | |
| Sample Number | Basis Weight (lb./csf) | Average | Stripe-Low | Stripe-High | Percent Difference | Basis Weight, lb/csf | Loss-On-Ignition (%) Average |
| 1 | 1.82 | 20.5 | 18.0 | 22.6 | 25.5 | 1.75 | 20.3 |
| 2 | 1.84 | 21.0 | 18.8 | 23.0 | 22.3 | 1.75 | 20.3 |
| 3 | 1.77 | 24.5 | 23.6 | 26.6 | 12.7 | 1.71 | 19.7 |
| 4 | 1.82 | 24.3 | 22.8 | 25.6 | 12.3 | 1.71 | 19.7 |
| 5 | 1.91 | 30.2 | 25.5 | 35.0 | 37.3 | 1.71 | 19.7 |
| 6 | 1.84 | 27.6 | 25.6 | 30.2 | 18.0 | 1.83 | 28.5 |
| 7 | 1.86 | 29.2 | 24.7 | 35.7 | 44.5 | 1.83 | 28.5 |

The LOI% measurements were made by weighing a cut section of a sample mat (Wt. A), igniting the cut section in a muffle furnace of 1157° F. (625° C.) for 5 to 10 minutes, and then weighing the cut section again after being allowed to cool to room temperature (Wt. B). The LOI% was then calculated as follows:

$$LOI\% = Wt.\ A - Wt.\ B / Wt.\ A \times 100$$

For the "Average" measurements, the cut sections were twelve (12) inch by twelve (12) inch squares randomly cut from the mat sample. For the "strip-low" and "stripe-high" measurements, the cut sections were strips cut from areas of lower or higher binder areas in the sample mat, respectively.

From the data shown in Table 2, it can be seen that the differentiated areas or stripes had an increase in binder concentration of from 12.3 percent to 44.5 percent over the areas of low binder concentration.

In summary, the present invention includes a reinforced glass fiber mat, illustrated in embodiments 104 and 204, and a method for forming such a mat. The glass fiber mats 104 and 204 have first portions having a lower binder concentration than adjoining second portions. In other words, a first portion is in contact with or borders a second portion of the mat wherein the concentration of binder 100 is a first portion is lower than a concentration of binder 100 is a second portion. Preferably, the difference in binder concentration between a first and second portions is at least approximately 5% LOI, although other differences are within the scope of this invention. Furthermore, the first and second portions can be formed along the lengths of mats 104 and 204 in a continuous process to provide a desired or predetermined pattern. As will be appreciated by those skilled in the art, the terms "first" and "second" can be interchanged with "relatively low" and "relatively high", respectively. In other embodiments, the term "first portion" may refer to a portion of a reinforced glass fiber mat according to this invention having a higher binder concentration that a "second portion" of the mat.

In accordance with the provisions of the patent statutes, the principle and mode of operation of this invention have been explained and illustrated in its preferred embodiments. However, it must be understood that this invention may be practiced otherwise than as specifically explained and illustrated without departing from its spirit or scope.

What is claimed is:

1. A glass fiber mat comprising:

a first portion having glass fibers dried with a relatively low binder concentration; and a second portion adjoining the first portion, the second portion having glass fibers dried with a higher binder concentration than the relatively low binder concentration in the first portion.

2. The glass fiber mat defined in claim 1 wherein the difference of binder concentration between the first portion and the second portion is at least approximately 5% LOI.

3. The glass fiber mat defined in claim 1 wherein the second portion forms a stripe adjoining the first portion.

4. The glass fiber mat defined in claim 1 wherein a plurality of second portions form stripes adjoining first portions.

5. The glass fiber mat defined in claim 1 wherein a pattern of first and second portions extends the length of the mat.

6. The glass fiber mat defined in claim 1 wherein the mat is fabricated into a shingle having at least one cut edge through a second portion.

7. A method of forming a glass fiber mat comprising the steps of:

forming glass fibers;

dispersing the glass fibers into an unbonded mat;

applying binder to the glass fibers to form a bonded mat; and selectively removing some of the binder from the glass fibers to provide a first portion of the bonded mat having a lower concentration of binder than an adjoining second portion of the bonded mat.

8. The method of forming a glass fiber mat defined in claim 7 wherein the binder is removed from a first portion of the glass fibers by a vacuum.

9. The method of forming a glass fiber mat defined in claim 8 wherein the vacuum is drawn through a slot configuration corresponding to a portion of the bonded mat wherein binder is removed.

10. The method of forming a glass fiber mat defined in claim 7 including the step of drying the glass fibers and remaining binder in the bonded mat.

11. The method of forming a glass fiber mat defined in claim 10 including the step of cutting the bonded mat through the second portion of the bonded mat having a relatively higher concentration of binder to form cut edges.

12. The method of forming a glass fiber mat defined in claim 7 wherein a difference of concentration of binder between the first and second portions is at least approximately 5% LOI.

13. A glass fiber mat formed by the method defined in claim 7.

14. A method of forming a glass fiber mat comprising the steps of:

forming glass fibers;

dispersing the glass fibers into an unbonded mat; and selectively applying binder to the glass fibers to provide a first portion of a bonded mat having a different concentration of binder than an adjoining second portion of the bonded mat.

15. The method of forming a glass fiber mat defined in claim 14 wherein binder is applied through a slot configuration corresponding with the differing concentrations of applied binder.

16. The method of forming a glass fiber mat defined in claim 14 wherein the first portion of the bonded mat has a lower concentration of binder than the adjoining second portion of the bonded mat.

17. The method of forming a glass fiber mat defined in claim 14 wherein the difference of concentration of binder between the first and second portions is at least approximately 5% LOI.

18. The method of forming a glass fiber mat defined in claim 16 including the steps of:

drying the glass fibers and binder of the bonded mat; and cutting through the second portion of the bonded mat to form a cut edge.

19. A glass fiber mat formed by the method defined in claim 14.

20. A shingle comprising a glass fiber mat and a coating of asphalt, wherein the glass fiber mat includes:

a first portion having glass fibers dried with a relatively low binder concentration; and a second portion adjoining the first portion, the second portion having glass fibers dried with a higher binder concentration than the relatively low binder concentration in the first portion.

21. The shingle defined in claim 20 wherein the difference of binder concentration between the first portion and the second portion of the mat is at least approximately 5% LOI.

22. The shingle defined in claim 20 wherein the second portion of the mat forms a stripe adjoining the first portion.

23. The shingle defined in claim 20 wherein a plurality of second portions form stripes adjoining first portions.

24. The shingle defined in claim 20 wherein a pattern of first and second portions extends the length of the mat.

25. The shingle defined in claim 20 wherein the shingle has at least one cut edge through a second portion of the mat.

* * * * *